US007444098B2

(12) United States Patent
Hamada et al.

(10) Patent No.: US 7,444,098 B2
(45) Date of Patent: Oct. 28, 2008

(54) IMAGE FORMING APPARATUS WITH CLEANING UNIT

(75) Inventors: Shuta Hamada, deceased, late of Hachioji (JP); by Akira Hamada, legal representative, Hyogo (JP); by Yoshiko Hamada, legal representative, Hyogo (JP); Takenobu Kimura, Hachioji (JP); Yotaro Sato, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 210 days.

(21) Appl. No.: 11/341,739

(22) Filed: Jan. 27, 2006

(65) Prior Publication Data

US 2006/0171735 A1 Aug. 3, 2006

(30) Foreign Application Priority Data

Feb. 1, 2005 (JP) ..... 2005-024907
Mar. 8, 2005 (JP) ..... 2005-063927

(51) Int. Cl.
*G03G 15/16* (2006.01)
*G03G 15/00* (2006.01)

(52) U.S. Cl. ..... 399/101; 399/49

(58) Field of Classification Search ..... 399/49, 399/101, 197

See application file for complete search history.

(56) References Cited

U.S. PATENT DOCUMENTS 7,215,920 B2 * 5/2007 Shida ..... 399/354
2004/0057762 A1 * 3/2004 Thayer ..... 399/353

FOREIGN PATENT DOCUMENTS

JP 60170879 A * 9/1985
JP 6-130875 5/1994
JP 6-332342 12/1994
JP 2000-4079 1/2000

* cited by examiner

*Primary Examiner*—Ryan Gleitz
(74) *Attorney, Agent, or Firm*—Cantor Colburn LLP

(57) ABSTRACT

There is described an image forming apparatus equipped with a cleaning unit to clean a belt-type transfer member. The cleaning unit includes: a conductive opposing roller that contacts an inner surface of the intermediate transfer member; a first conductive blush member and a second conductive blush member, both of which are pressed against the conductive opposing roller while putting the intermediate transfer member between them; a cleaning-voltage applying power source to apply a cleaning voltage having a polarity opposite to that of the residual toner onto the first conductive blush member; and an opposing-roller potential controlling unit to control an electric potential state of the conductive opposing roller, so that an electric potential difference, between the first conductive blush member and the conductive opposing roller at a time when the secondary transferring unit is deactivated, is larger than that at a time when the primary transferring unit is activated.

7 Claims, 6 Drawing Sheets

IMAGE FORMING APPARATUS WITH CLEANING UNIT

The present invention claims priority under 35 U.S.C. §119 to Japanese Application No. 2005-024907 filed Feb. 1, 2005 and to Japanese Application No. 2005-063927 flied Mar. 8, 2005, both of which are incorporated herein by reference.

BACKGROUND

This invention relates to an electrophotographic image forming apparatus.

An electrophotographic color image forming method used, for example, by a copying machine or printer forms a visible image by forming a toner image on a photoreceptor or belt-type transfer member by a toner image forming unit, transferring the toner image-to a transfer material by an image transferring device, and fixing the transfer material. The toner left unused on the belt-type transfer member is removed by a cleaning device.

One of toner cleaning devices uses a bias roller such as a conductive brush roller to remove residual toner electrostatically. Usually, however, toner particles left on the belt-type transfer member have both positive and negative charges even when toner particles in the toner image forming unit, for example, in a developer are charged negatively. This is because the toner particles are charged oppositely to the charge polarity of the toner particles in the developer by the transferring electric field formed in the transferring unit. Therefore, it is impossible for such a cleaning device to remove the positively- and negatively-charged residual toner particles by a single brush roller.

To solve such a problem, a cleaning device has been proposed which has, for example, two brush rollers one of which has a positive cleaning voltage and the other has a negative cleaning voltage (for example, in Tokkaihei 6-130875 (Japanese Non-Examined Patent Publication) and Tokkaihei 6-332342 (Japanese Non-Examined Patent Publication)).

However, there is the possibility that such a cleaning device cannot completely remove toner particles to form toner patches for detection of image density on a belt-type transfer member in order to control the density and gray scale of a visible image.

This is because the toner patch formed on the belt-type transfer member remains non-transferred on the belt-type transfer member when the transferring unit is not working and because the toner is too much to be removed by the above cleaning unit.

Similarly, when a transfer material jams, the transferring unit stops and a lot of non-transferred toner particles remain on the belt-type transfer member. This causes a similar problem.

To overcome the abovementioned problems, there has been proposed another cleaning unit, which applies a specific and large cleaning bias voltage when a large amount of non-transferred toner happens to remain (for instance, set forth in Tokkai 2000-04079 (Japanese Non-Examined Patent Publication)).

However, since it is necessary for the abovementioned cleaning unit to set the cleaning bias voltage at such a value that is appropriate for the most severe condition for removing the large amount of non-transferred toner, there have been problems that the abovementioned cleaning unit should have a high-power outputting capability with a power source having a large capacity, and therefore, a danger of electric current leak becomes a high-risk factor. Specifically, in a configuration in which a pair of plus and minus electrodes create an electric field, the cleaning bias voltage becomes very high when cleaning non-transferred toner.

Another cleaning device has been proposed which contains a bias voltage applying device and two cleaning brushes between which voltages of an identical polarity are changed (for example, in Tokkaihei 6-130875 (Japanese Non-Examined Patent Publication)).

[Patent Documents 1]

Tokkaihei 6-130875 (Japanese Non-Examined Patent Publication)

[Patent Documents 2]

Tokkaihei 6-332342 (Japanese Non-Examined Patent Publication)

[Patent Documents 3]

Tokkai 2000-04079 (Japanese Non-Examined Patent Publication)

Further, the method of changing the same voltage between the cleaning brushes to the bias voltage applying unit and two cleaning brushes (for instance, set forth in Tokkaihei 6-332342 (Japanese Non-Examined Patent Publication)).

[Patent Documents 4]

Tokkaisho 60-170879 (Japanese Non-Examined Patent Publication)

Tokkaihei 6-130875 (Japanese Non-Examined Patent Publication) and Tokkaisho 60-170879 (Japanese Non-Examined Patent Publication) disclose an image forming apparatus which forms, on an intermediate transfer member, a patch image to control the image density and a patch image to correct timing of forming an image of each color (Y, M, C, and K) to form a color image. However, in such an image forming apparatus, an image formed on the intermediate transfer member must be cleaned after the image density is controlled or image timing is corrected. Further, if a transfer material jams before a toner image is transferred from the intermediate transfer member to the transfer material, a lot of toner (if any) on the intermediate transfer member cannot be removed by a single cleaning process and some toner may be left on the intermediate transfer member after the cleaning process. This toner left on the intermediate transfer member will cause image problems such as color mingling in image formation, stains on the back side of the transfer material, and insufficient image density control.

Tokkaihei 6-130875 (Japanese Non-Examined Patent Publication) also discloses a cleaning method which contains a bias voltage applying device and two cleaning brushes between which voltages of the same polarity are changed. However, the additional bias voltage applying device makes the configuration complicated.

To solve the above problem, it may be possible to conceive a method of providing two cleaning modes and changing polarities of the brush rollers to clean toner left non-transferred on the intermediate transfer member. The first cleaning mode forms an image according to normal image, transfers the toner image to a transfer material, and reverses the polarity of voltages applied to the two brush rollers to remove toner particles left on the intermediate transfer member.

The second cleaning mode applies voltages of a positive polarity to the two brush rollers to remove toner particles left on the intermediate transfer member since the non-transferred toner particles are charged negatively (which is the regular polarity).

However, we found that this cleaning method cannot be free from causing image problems and insufficient image density control that generated by the cleaning rollers of Tokkaihei 6-130875 (Japanese Non-Examined Patent Publication) and Tokkaisho 60-170879 (Japanese Non-Examined Patent Publication) since toner particles of a positive polarity brushed out by the brush rollers whose polarity was changed from negative to positive stuck to the intermediate transfer member and remained after the cleaning process.

SUMMARY

An embodiment of the present invention may provide an image forming apparatus which is equipped with two brush rollers to clean a belt-type transfer member, may completely remove toner particles left non-transferred on the belt-type transfer member, and may always present stainless images.

Further, an embodiment of the present invention may provide an image forming apparatus which can prevent image problems and insufficient image density control without any complicated unit and may completely remove normal residual toner particles and non-transferred toner particles such as patch image toner from the intermediate transfer member and a cleaning method thereof.

Accordingly, the present invention can be attained by image forming apparatus described as follows.

(1) An image forming apparatus, comprising: a toner image forming unit to form a toner image on an image bearing member by employing toner; an intermediate transfer member driven to rotate; a primary transferring unit to transfer the toner image formed on the image bearing member onto the intermediate transfer member; a secondary transferring unit to transfer the toner image residing on the intermediate transfer member onto a transfer material; and a cleaning unit to clean residual toner remaining on the intermediate transfer member; wherein the cleaning unit includes: a conductive opposing roller that contacts an inner surface of the intermediate transfer member; a first conductive brush member and a second conductive brush member, both of which are pressed against the conductive opposing roller while putting the intermediate transfer member between them; an electric current path that is formed so as to allow an electric current to flow between the first conductive brush member and the second conductive brush member through the conductive opposing roller; a cleaning-voltage applying power source to apply a cleaning voltage having a polarity opposite to that of the residual toner onto the first conductive brush member or the second conductive brush member; and an opposing-roller potential controlling unit to control an electric potential state of the conductive opposing roller, so that an electric potential difference, between the first conductive brush member and the conductive opposing roller at a time when the secondary transferring unit is deactivated, is larger than that at a time when the primary transferring unit is activated.

(2) An image forming apparatus, comprising: a toner image forming unit to form a toner image on an image bearing member by employing toner; an intermediate transfer member driven to rotate; a primary transferring unit to transfer the toner image formed on the image bearing member onto the intermediate transfer member; a first cleaning unit to remove residual toner remaining on the image bearing member after a primary transferring operation is completed; a secondary transferring unit to transfer the toner image residing on the intermediate transfer member onto a transfer material; a second cleaning unit to clean residual toner remaining on the intermediate transfer member, wherein the second cleaning unit includes a first brush roller and a second brush roller disposed at a position downstream from the first brush roller in a moving direction of the intermediate transfer member, each of which is driven to rotate while contacting the intermediate transfer member so as to clean the intermediate transfer member; and a controller to control a voltage to be applied to the first brush roller and a voltage to be applied to the second brush roller, and to control the primary transferring unit; wherein the image forming apparatus are provided with a first mode in which image forming operations based on normal image data are conducted and a second mode in which patch image forming operations based on patch image data are conducted; and wherein, in the first mode, the controller applies a voltage having a negative polarity to the first brush roller, a voltage having a positive polarity to the second brush roller and a voltage having a predetermined polarity to the primary transferring unit, respectively, while in the second mode, the controller applies a voltage having a positive polarity to the first brush roller, a voltage having a positive polarity to the second brush roller and a voltage having the predetermined polarity same as that in the first mode to the primary transferring unit, respectively.

(3) A cleaning method for cleaning residual toner in an image forming apparatus, which includes: a toner image forming unit to form a toner image on an image bearing member by employing toner; an intermediate transfer member driven to rotate; a primary transferring unit to transfer the toner image formed on the image bearing member onto the intermediate transfer member; a first cleaning unit to remove residual toner remaining on the image bearing member after a primary transferring operation is completed; a secondary transferring unit to transfer the toner image residing on the intermediate transfer member onto a transfer material; and a second cleaning unit to clean residual toner remaining on the intermediate transfer member, wherein the second cleaning unit includes a first brush roller and a second brush roller disposed at a position downstream from the first brush roller in a moving direction of the intermediate transfer member, each of which is driven to rotate while contacting the intermediate transfer member so as to clean the intermediate transfer member; wherein the cleaning method is conducted in a first mode in which image forming operations based on normal image data are conducted or in a second mode in which patch image forming operations based on patch image data are conducted; the cleaning method comprising: applying a voltage having a negative polarity to the first brush roller and a voltage having a positive polarity to the second brush roller, respectively, in the first mode; applying a voltage having a positive polarity to the first brush roller and a voltage having a positive polarity to the second brush roller, respectively, in the second mode; applying a voltage having a positive polarity to the primary transferring unit in order to inversely transfer toner, ejected from the first brush roller to the intermediate transfer member, onto the image bearing member; and removing the toner inversely transferred onto the image bearing member by means of the first cleaning unit.

(4) An image forming apparatus, comprising: a toner image forming unit to form a toner image on an image bearing member by employing toner; an intermediate transfer member onto which the toner image is transferred; a primary transferring unit to transfer the toner image formed on the image bearing member onto the intermediate transfer member; a first cleaning unit to remove residual toner remaining on the image bearing member after a primary transferring operation is completed; a secondary transferring unit to transfer the toner image residing on the intermediate transfer member onto a transfer material; a second cleaning unit to clean residual toner remaining on the intermediate transfer member, wherein the cleaning unit includes a first brush roller and a second brush roller disposed at a position downstream from the first brush roller in a moving direction of the intermediate transfer member, each of which is driven to rotate while contacting the intermediate transfer member so as to clean the intermediate transfer member; and a controller to control a voltage to be applied to the first brush roller and a voltage to be applied to the second brush roller; wherein the image forming apparatus are provided with a first mode in which image forming operations based on normal image data are conducted and a second mode in which patch image forming operations based on patch image data are conducted; and wherein, in the first mode, the controller applies a voltage having a negative polarity to the first brush roller and a voltage having a positive polarity to the second brush roller, respectively, while in the second mode, the controller initially applies a voltage having a positive polarity to the first brush roller and the a voltage having a positive polarity to the second brush roller, respectively, and then, applies a voltage having a negative polarity to the first brush roller and a voltage having a positive polarity to the second brush roller.

(5) A cleaning method for cleaning residual toner in an image forming apparatus, which includes: a toner image forming unit to form a toner image on an image bearing member by employing toner; an intermediate transfer member driven to rotate; a primary transferring unit to transfer the toner image formed on the image bearing member onto the intermediate transfer member; a first cleaning unit to remove residual toner remaining on the image bearing member after a primary transferring operation is completed; a secondary transferring unit to transfer the toner image residing on the intermediate transfer member onto a transfer material; and a second cleaning unit to clean residual toner remaining on the intermediate transfer member, wherein the second cleaning unit includes a first brush roller and a second brush roller disposed at a position downstream from the first brush roller in a moving direction of the intermediate transfer member, each of which is driven to rotate while contacting the intermediate transfer member so as to clean the intermediate transfer member; wherein the cleaning method is conducted in a first mode in which image forming operations based on normal image data are conducted or in a second mode in which patch image forming operations based on patch image data are conducted; the cleaning method comprising: applying a voltage having a negative polarity to the first brush roller and a voltage having a positive polarity to the second brush roller, respectively, in the first mode; and applying at first a voltage having a positive polarity to the first brush roller and a voltage having a positive polarity to the second brush roller, and then, at a time before toner ejected from the first brush roller to the intermediate transfer member arrive at the first brush roller, applying a voltage having a negative polarity to the first brush roller and a voltage having a positive polarity to the second brush roller.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
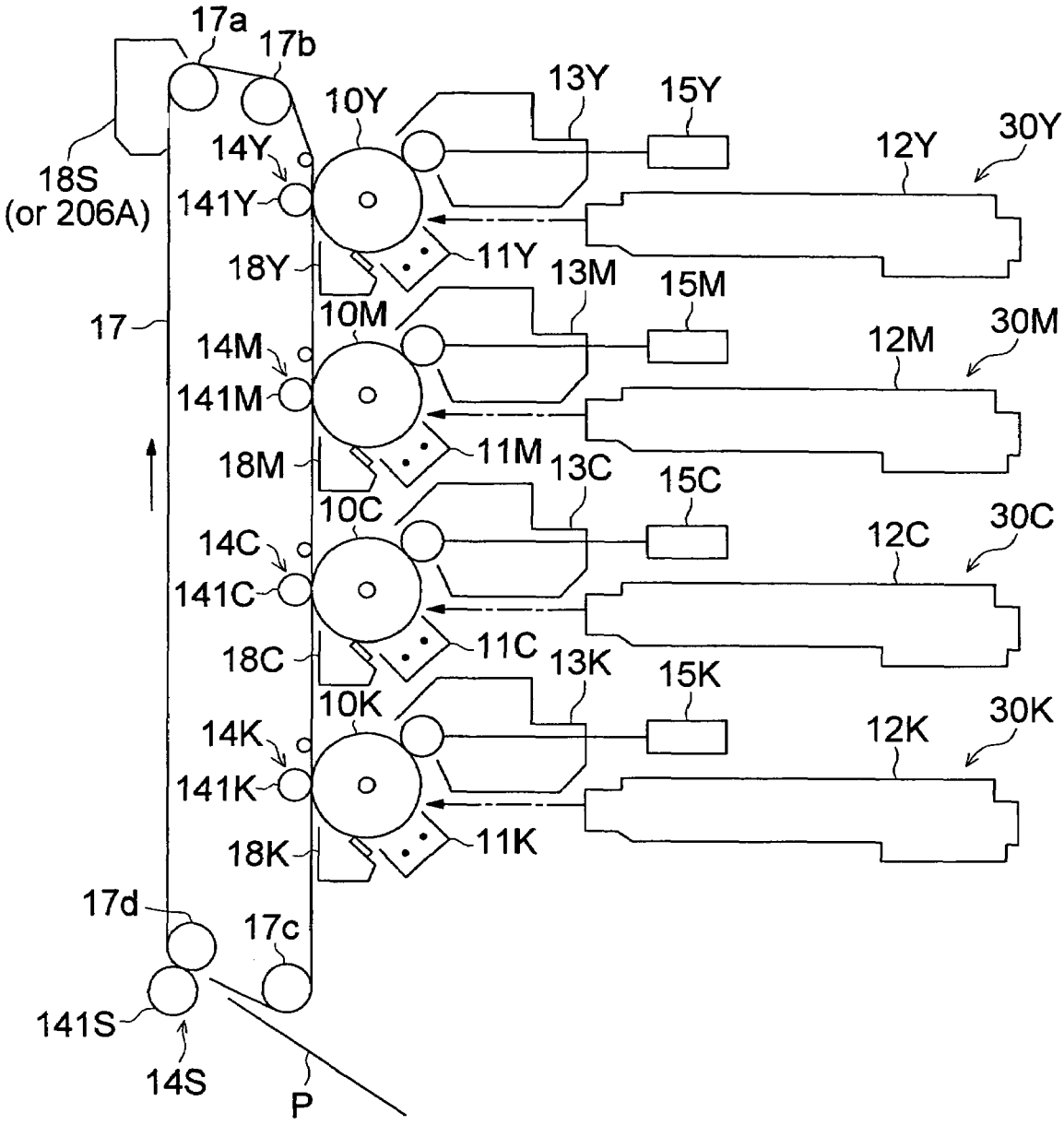
FIG. 1 shows an explanatory schematic diagram of the first embodiment of an image forming apparatus embodied in the present invention.

Referring to the drawings, embodiments of the present invention will be detailed in the following.

FIG. 1 shows an explanatory schematic diagram of the first embodiment of the image forming apparatus embodied in the present invention.

The image forming apparatus, serving as an image forming apparatus for forming a color image, employs the intermediate transferring method, so to speak, which includes: forming each of a plurality of toner images having different color onto each of a plurality of image bearing members; sequentially transferring each of the unicolor toner images onto a common belt-type transfer member so as to overlap the unicolor toner images with each other on the belt-type transfer member; and then, transferring the full color toner image, formed on the belt-type transfer member, onto a transfer material P at a time as a transferring operation.

The image forming apparatus is provided with a belt-type transfer member 17, which is made of an endless type belt and is circularly moved in a direction indicated by an arrow shown in FIG. 1. In an arranging area of toner image forming units disposed at the outer circumferential region of the belt-type transfer member 17, four toner image forming units 30Y, 30M, 30C, 30K, for forming a yellow toner image, a magenta toner image, a cyan toner image, a black toner image, respectively, are disposed in such a manner that these are arrayed along the moving direction of the belt-type transfer member 17 while sequentially separating from each other. The belt-type transfer member 17 is threaded on various kinds of rollers including a conductive opposing roller 17*a* detailed later (hereinafter, referred to as an opposing roller 17*a*, for simplicity), 17*b*, 17*c* and 17*d*, so that the belt-type transfer member 17 is circularly moved while being contacted image bearing members 10Y, 10M, 10C, 10K by pushing actions of primary transferring devices 14Y, 14M, 14C, 14K in the toner image forming units 30Y, 30M, 30C, 30K, respectively.

The belt-type transfer member 17 is made of the endless belt, having semiconductivity, mass resistivity in a range of $1\times10^{8}$-$1\times10^{10}$ Ωcm and surface resistivity in a range of $1\times10^{4}$-$1\times10^{12}$ Ω/cm$^2$. The surface resistivity is measured by applying a voltage of 100 V for 10 seconds under the environment of room temperature and room humidity (temperature: 20±1° C., humidity: 50±2%) by means of the resistivity measuring instrument (Hiresta IP, manufactured by Yuka Electronic Co.).

It is preferable that the belt-type transfer member 17 is made of polyimide, such as, for instance, a heat curing polyimide, a modification polyimide, etc.

Further, the moving velocity of the belt-type transfer member 17 is set at a value in a range of, for instance, 200-500 mm/sec.

The toner image forming units 30Y for forming a toner image of color Y (Yellow) is provided with an image bearing member 10Y being a photoreceptor drum to be rotated. In the peripheral space along the circumferential surface of the image bearing member 10Y, a charging device 11Y, an exposing device 12Y and a developing device 13Y for developing a yellow toner image by using developing agent for color Y (Yellow) are arranged in a rotating direction of the image bearing member 10Y according to this order. Further, a cleaning device 18Y having a cleaning blade for cleaning the image bearing member is disposed at a downstream side of a primary transferring device 14Y, which is disposed at a downstream position of the developing device 13Y in the rotating direction of image bearing member 10Y.

Further, the density detecting sensor 19Y, for detecting density of the toner image formed on the image bearing member 10Y, is disposed at a position downstream from the developing device 13Y and upstream from the primary transferring device 14Y.

For instance, the image bearing member 10Y is provided with a photosensitive layer, which is coated on a drum-shaped metal base member and is made of a resin material containing an organic photoconductive material. In FIG. 1, the image bearing member 10Y is arranged in such a manner that the longitudinal direction of the photoreceptor drum is extended in a direction perpendicular to the paper surface.

The charging device 11Y includes, for instance, a scorotron charger having a grid electrode and a discharging electrode, while the exposing device 12Y includes, for instance, a laser beam irradiating device.

The developing device 13Y includes a developing sleeve, which rotates and which incorporates a magnet to retain developing agent while rotating, and a voltage applying device (not shown in the drawings) for applying a DC bias voltage and/or an AC bias voltage to a gap between the image bearing member 10Y and the developing sleeve.

The primary transferring device 14Y is constituted by a primary transferring roller 141Y that is provided so as to form a primary transferring region in a state of press-contacting the surface of the image bearing member 10Y while putting the belt-type transfer member 17 between them, and a transfer-current supplying device (not shown in the drawings) including, for instance, a constant current source coupled to the primary transferring roller 141Y. The yellow toner image, residing on the image bearing member 10Y, is electrostatically transferred onto the belt-type transfer member 17 by supplying a primary transferring current outputted from the transfer-current supplying device to the primary transferring roller 141Y. The abovementioned method is called as the contact-transferring method.

The cleaning blade for cleaning the image bearing member, provided in the cleaning device 18Y, is made of an elastic material, such as, for instance, a polyurethane rubber, etc. The base portion of the cleaning blade is supported by a supporting member, while the leading edge portion of the cleaning blade contacts the surface of the image bearing member 10Y. Further, the cleaning blade is extended from the base portion in a counter direction, opposite to the rotating direction of the image bearing member 10Y at the contacting point.

Each configuration of the toner image forming units 30M, 30C, 30K is the same as that of the toner image forming units 30Y for forming a toner image of color Y (Yellow), except that the developing agent includes each of magenta toner, cyan toner and black toner, instead of yellow toner.

A secondary transferring device 14S is disposed at a position downstream from the toner image forming unit 30K for forming a toner image of color K (Black). The secondary transferring device 14S is constituted by a secondary transferring roller 141S that is provided so as to form a transferring region in a state of press-contacting the backup roller 17*d* while putting the belt-type transfer member 17 between them, and a transfer-current supplying device (not shown in the drawings) coupled to the secondary transferring roller 141S. The full color toner image, formed on the belt-type transfer member 17, is transferred onto a conveyed transfer material P by supplying a transferring current outputted from the transfer-current supplying device to the secondary transferring roller 141S. The abovementioned method is called as the contact-transferring method.

When a toner patch is formed on the belt-type transfer member 17 to control the density of a visible image and gradation or when a transfer material P jams in the transfer path, the transfer operation stops. In such a case, the secondary transferring device 14S receives a Toner Patch Formation signal or a Jam Reset signal from a central processing unit (which is not shown in the drawings) and becomes inactive.

Next, as the first embodiment of the present invention, a cleaning device 18S will be detailed in the following.

Figure 2:
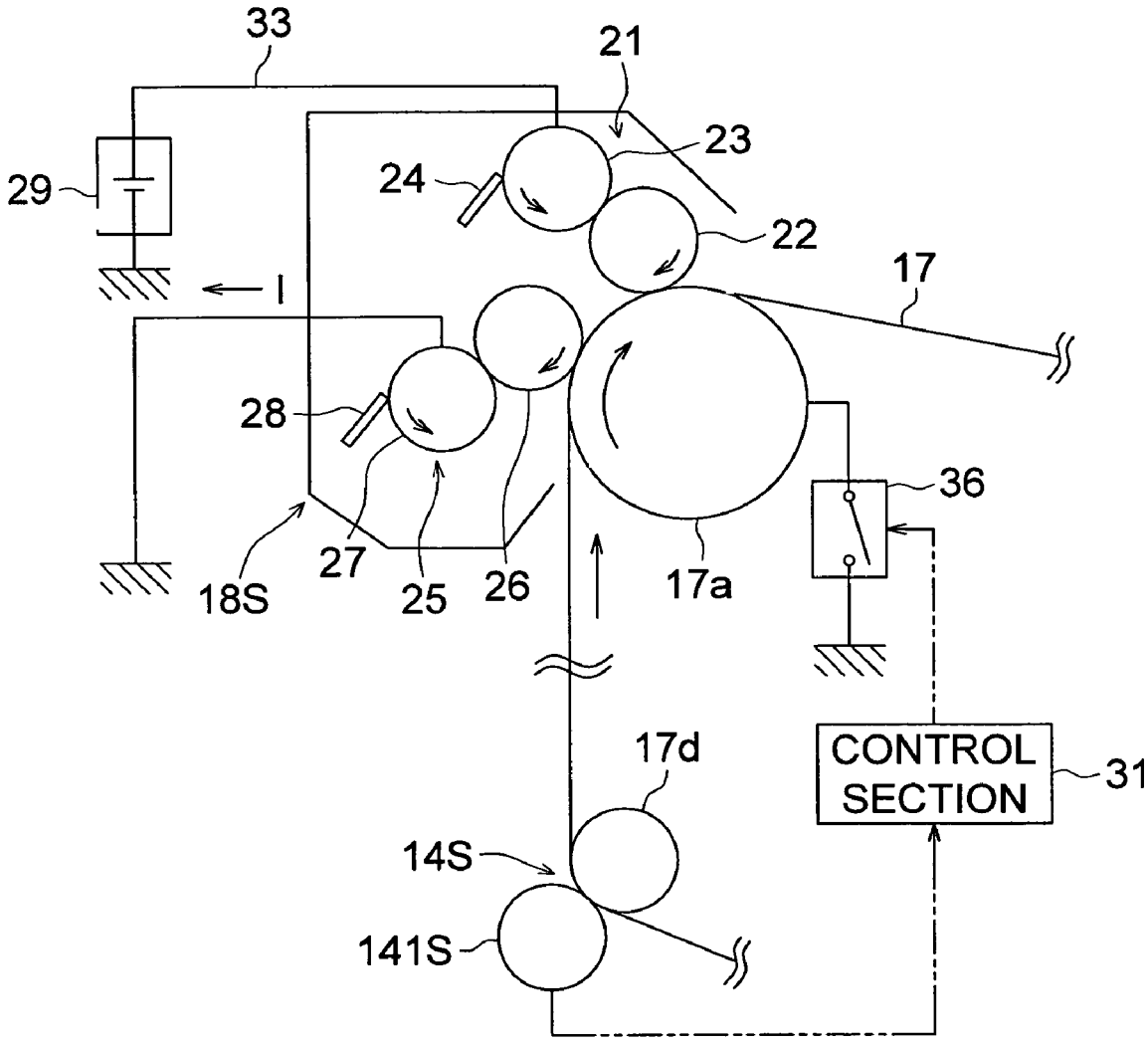
FIG. 2 shows an explanatory schematic diagram of a cleaning device equipped in an image forming apparatus embodied in the present invention, illustrating an enlarged peripheral view of the cleaning device.

A cleaning device 18S to remove residual toner from the belt-type transfer member 17 is provided in a downstream side of the secondary transferring device 14S along the movement of the belt-type transfer member. As shown in FIG. 2, the cleaning device 18S is equipped with an opposing roller 17*a* which is in contact with the inner surface of the belt-type transfer member 17, and first and second brush roller systems. The first brush roller system 21 contains a first conductive brush roller 22 (hereinafter also called "first brush roller") which is in contact with the outer surface of the belt-type transfer member 17, a first flicker rod 23 which is a toner recovering roller in contact with the first brush roller 22, and a scraper 24 which is in contact with the first flicker rod 23. The second brush roller system 25 contains a second conductive brush roller 26 (hereinafter also called "second brush roller") which is another conductive brush roller in contact with the outer surface of the belt-type transfer member 17 and located in the upstream side of the first brush roller 22 along the movement of the belt-type transfer member 17, a second flicker rod 27 which is a toner recovering roller in contact with the second brush roller 26, and a plate-shaped scraper 28 which is in contact with the second flicker rod 27.

The first brush roller 22 is pressed against the opposing roller 17*a* with the belt-type transfer member 17 therebetween. The first brush roller 22 has bristles such as conductive nylon bristles densely implanted on the outer surface of the roller body. The brush bristles have a diameter of, for example, 5 to 8 deniers, a length of, for example, 2 to 5 mm, an electric resistance of, for example, $1\times10^{9}$ to $1\times10^{11}$ Ω, a Young's modulus of, for example, 4,900 to 9,800 N/mm$^2$, and an implantation density (number of bristles per unit area) of, for example, 50 to 200 kilo bristles per square inch.

The first brush roller 22 is disposed so that the bristles may bite the belt-type transfer member 17 by 1 mm. This "bite quantity of bristles" of the first brush roller 22 means the maximum length of bristles which enter (overlap) the belt-type transfer member space when the belt-type transfer member 17 is removed.

The first flicker rod 23 in the first brush roller system 21 is to remove toner particles from the first brush roller 22 and the diameter thereof is, for example, 8 to 30 mm. It is made of, for example, stainless steel. The first brush roller 22 is disposed so that the rod 23 may bite the first brush roller 22 by 1 mm. This "bite quantity to the first brush roller" means the maximum length of bristles which enter the first flicker rod space when the first flicker rod 23 is removed.

The scraper 24 is a plate to mechanically remove toner from the first flicker rod 23. The scraper 24 is, for example, 0.05 mm thick.

The second brush roller 26 is pressed against the opposing roller 17*a* with the belt-type transfer member 17 therebetween.

The second brush roller 26, second flicker rod 27, and scraper 28 in the second brush roller system 25 are the same in materials as the first brush roller 22, first flicker rod 23, and scraper 24 in the first brush roller system 21. The bite quantity of the second brush roller 26 to the belt-type transfer member 17 is 1 mm and the bite quantity of the second flicker rod to the second brush roller 26 is 1 mm.

The brush rollers 22 and 26 are made to rotate, for example, at a speed of 100 to 250 mm/sec oppositely (clockwise in FIG. 2) to the movement of the belt-type transfer member respectively at points where the brush rollers 22 and 26 touch the belt-type transfer member 17. The flicker rods 23 and 27 are made to rotate in the same direction as the brush rollers 22 and 26 rotate (counterclockwise in FIG. 2).

This cleaning device 18S has a circuit path 33 which flows a current to the conductive rollers 22 (first brush roller), 17*a* (opposing roller), and 26 (second brush roller). A power supply 29 is provided to apply a cleaning voltage of a polarity opposite to the charge polarity of toner in the developers 13Y, 13M, 13C and 13K (hereinafter called "developing polarity of toner") to the first brush roller 22 via the first flicker rod 23. When a cleaning voltage is applied to first brush roller 22, a cleaning current flows to the first brush roller 22, the opposing roller 17*a*, and the second brush roller 26 in that order through the current path 33.

The brush rollers 22 and 26 brush off residual toner from the belt-type transfer member 17 and remove them electrostatically. When the developing polarity of the used toner is negative, the first brush roller 22 in the current path 33 has a function to remove negatively-charged toner particles among toner particles left on the belt-type transfer member 17 and the second brush roller 26 has a function to remove positively-charged toner particles among the toner particles.

The magnitude of a cleaning voltage to be applied to the first flicker rod 23 by the cleaning voltage applying device 29 is, for example, +200 to +1000 V when the developing polarity of toner is negative.

The opposing roller 17*a* also works as a roller to support and stretch the belt-type transfer member 17. The roller 17*a* is a hard roller made of an aluminum core bar and the outer diameter is, for example, 20 to 80 mm.

The image forming apparatus is equipped with a mechanism 36 to control the potential of the opposing roller 17*a*. The mechanism 36 contains a changeover switch which applies, to the opposing roller 17*a*, the same potential as the second brush roller 26 when the switch is made. When the secondary transferring device 14S becomes inactive, the mechanism 36 is controlled to be active. In other words, when the secondary transferring device 14S becomes inactive, the control section 31 controls so that the potential difference $V1_{off}$ between the opposing roller 17*a* and the first brush roller 22 when the secondary transferring device 14S becomes inactive may be greater than the potential difference $V1_{on}$ between the opposing roller 17*a* and the first brush roller 22 when the secondary transferring device 14S is active.

In the cleaning device 18S, for example, the second brush roller 26 is earthed to the ground potential. When the control mechanism 36 becomes active, the opposing roller 17*a* is also earthed to the ground potential.

Toner

It is preferable that a mass average particle size of the toner to be employed in the image forming apparatus aforementioned is in a range of 4-7 μm. By employing the toner having the mass average particle size in a range of 4-7 μm, it becomes possible to reduce such toner that have an excessive adhesive property or a weak adhesive force for the transfer material P in a fixing process performed by a fixing apparatus (not shown in the drawings), resulting in a long time stability of the developing efficiency. Further, since the high transferring efficiency can be achieved, it also becomes possible not only to improve the image quality of a halftone image area, but also to form a visual image in which the image quality of fine lines and that of dots are improved.

Incidentally, hereinafter, the mass average particle size of the toner is measured by employing the "Coulter Counter TA II" or the "Coulter Multi-sizer" (both manufactured by Coulter Co.).

The abovementioned toner is acquired by polymerizing the polymerization monomer in the water-type agent. For instance, fine polymerized particles are manufactured by employing an emulsion polymerization method or by emulsion-polymerizing the monomer in the liquid including emulsion liquid being a necessary addition agent, and then, the abovementioned toner are manufactured by employing the method of adding and associating an organic solvent, a flocculant, etc. Further, the abovementioned toner can be also manufactured by employing the method of mixing and associating a releasing agent, a coloring agent, etc., being necessary constituents of the toner, with the monomer, or by employing the method of dispersing constituents of the toner, such as the releasing agent, the coloring agent, etc., into the monomer, and then, emulsion-polymerizing them, etc. Incidentally, the term of "association" means that a plurality of resin particles and a plurality of coloring agent particles fuse into each other. Further, the water-type agent, defined in an embodiment of the present invention, may contains water at least 50%-by-mass.

An example of such the method for manufacturing the toner includes: adding various kinds of constituents, such as the coloring agent, the releasing agent, the charge controlling agent, the polymerizing initiation agent, etc., as needed, into the polymerization monomer; dissolving or dispersing the various kinds of constituents into the polymerization monomer by using a homogenizer, a sand mill, a sand grinder, an ultrasound dispersing machine, etc.; dispersing the polymerization monomer, in which the various kinds of constituents are dissolved or dispersed, in the water-type agent including a dispersing stabilizer into oil particles each of which has a desired dimension as a toner particle; heating them in a reacting apparatus to accelerate the polymerizing reaction; and after the polymerizing reaction is completed, adjusting the toner by removing the dispersing stabilizer, by filtering, by washing, and further, by drying.

It is preferable that the sphericity of the toner mentioned in the above is in a range of 0.94-0.98. The sphericity of the toner is calculated by employing the following equation 1, after analyzing the 500 toner-particle images, which are randomly sampled from toner particle images magnified 500 hundred times by the scanning type electronic microscope (SEM), by employing the Scanning Image Analyzer (manufactured by Japan Electronic Co. Ltd.).

$$\text{Sphericity} = \text{"circumferential length of a circle derived from circle equivalent diameter"} / \text{"circumferential length of a projected particle image"} \quad (1)$$

As for the toner whose sphericity is lower than 0.94, the unevenness of the particles are getting large. Accordingly, such the toner particles are liable to be destructed, and since the toner particles are not uniformly charged in each of the developing devices 13Y, 13M, 13C, 13K, it is impossible to form a good visual image. On the other hand, as for the toner whose sphericity is greater than 0.98, the cleaning efficiency is getting deteriorated, since the each particle is getting close to the true sphere.

In the image forming apparatus embodied in the present embodiment, by employing the developing agent, which includes the small-sized spherical toner manufactured by the aforementioned method and whose shape fulfill the specific condition, it becomes possible not only to improve the image quality of a halftone image area, but also to form a visual image in which the image quality of fine lines and that of dots are improved.

The aforementioned toner can be employed for either one component developing agent or two component developing agent.

When employed for one component developing agent, the non-magnetized one component developing agent, or the magnetized one component developing agent, in which magnetic particles in a range of 0.1-0.5 μm are included with toner, can be cited as an applicable example.

When employed for two component developing agent mixed with carrier, materials, such as an iron, a ferrite, a magnetite, an alloy of these metal and aluminum, an alloy of these metal and lead, etc., can be conventionally and preferably employed as the magnetic carrier particles, and specifically, the ferrite particles are preferable. It is preferable that the mass average particle diameter of the abovementioned magnetic carrier particles is in a range of 15-100 μm, and more preferable, in a range of 25-80 μm. The mass average particle diameter of the carrier particles can be measured by employing the laser diffraction sensor HELOS (manufactured by Sympatec Co. Ltd.) as a representative measuring instrument provided with a wet dispersing unit.

In the image forming apparatus, the image forming operations are conducted as follows.

In each of the toner image forming units 30Y, 30M, 30C, 30K, each of the image bearing member 10Y, 10M, 10C, 10K is driven to rotate. Each of the image bearing members 10Y, 10M, 10C, 10K is charged at a predetermined polarity, for instance, a negative polarity, by the charging device 11Y, 11M, 11C, 11K. Next, on an image forming area of the surface of each image bearing member on which a toner image is to be formed, an electronic potential of an irradiated portion (an exposed region) is lowered by an exposing action performed by each of the exposing device 12Y, 12M, 12C, 12K so as to form an electrostatic latent image corresponding to the original image on each of image bearing members 10Y, 10M, 10C, 10K. Then, in each of the developing devices 13Y, 13M, 13C, 13K, the reverse developing operation is performed in such a manner that toner charged at, for instance, a negative polarity, namely, the same as that of the surface potential of each of the image bearing members 10Y, 10M, 10C, 10K, are attached to the electrostatic latent image formed on each of the image bearing members 10Y, 10M, 10C, 10K, to form a unicolor toner image corresponding to each of colors Y, M, C, K.

Further, each of the unicolor toner images is sequentially transferred onto the primary transferring area on the belt-type transfer member 17 by each of the primary transferring device 14Y, 14M, 14C, 14K, so that the unicolor toner images of colors Y, M, C, K overlap with each other to form a full color image on the belt-type transfer member 17.

Then, the color toner image, formed on the belt-type transfer member 17, is transferred onto the transfer material P by applying a transferring voltage, adjusted at an appropriate amplitude by the transfer-voltage supplying device, to the secondary transferring roller 141S of the secondary transferring device 14S. Successively, in the fixing process, a fixing device fixes the color toner image onto the transfer material P, to form a full color image.

In each of the toner image forming units 30Y, 30M, 30C, 30K, residual toner, remaining on each of the image bearing members 10Y, 10M, 10C, 10K after passing through the primary transferring region, are removed by the image bearing member cleaning blade equipped in each of the cleaning devices 18Y, 18M, 18C, 18K.

Toner left on the belt-type transfer member 17 after passing through the secondary transfer region are removed by the cleaning device 18S.

Specifically, in a normal service status, when the secondary transferring device 14S is made active, the cleaning voltage applying device 29 applies a cleaning voltage to the first brush roller 22. With this, a cleaning current flows through the current path 33. Consequently, the first brush roller 22 electrostatically removes toner particles which are charged negatively. The second brush roller 26 electrostatically removes toner particles which are charged positively.

The flicker rods 23 and 27 respectively scrape off toner from the first and second brush rollers 22 and 26. (Toner particles are moved to the flicker rods 23 and 27 by difference in the electric potentials.) Toner particles on the flicker rods 23 and 27 are scraped off the scrapers 24 and 28 into a recovery tray for recovery and recycling.

Meanwhile, when the secondary transferring device 14S is made inactive, the mechanism 36 to control the potential of the opposing roller is switched to earth the opposing roller 17*a* to the ground potential. Consequently, the potential difference between the opposing roller 17*a* and the first brush roller 22 becomes greater. This status is very effective to remove a lot of non-transferred residual toner. In this status, the cleaning voltage applying device 29 applies a cleaning voltage to the first brush roller 22. With this, a cleaning current flows through the current path 33. Finally, the first brush roller 22 electrostatically removes a lot of non-transferred residual toner which passed through the secondary transfer region.

In accordance with the above image forming apparatus, when the secondary transferring device 14S is made inactive, the potential difference becomes greater between the opposing roller 17*a* and the first brush roller 22 which receives a cleaning voltage whose polarity is opposite to the developing polarity of the toner. This increases the performance of the cleaning device 18S to remove toner whose polarity is opposite to the developing polarity of the toner. This can facilitate the cleaning device 18S to accomplish a preferable cleaning performance. Therefore, the cleaning device 18S can utilize its preferable cleaning performance also upon the non-transferred toner left on the belt-type transfer member. In other words, non-transferred toner can be completely removed from the belt-type transfer member and images can be free from stains.

The present invention is embodied in the above description, but it should be understood that the above-described embodiment is not limited by any of the details of the foregoing description. Variations may be made by one skilled in the art without departing from the spirit and scope of the invention.

For example, as far as the potential difference between the first brush roller 22 and the opposing roller 17*a* is set to a desired value when the secondary transferring device 14S is made inactive, the opposing roller 17*a* need not be earthed to the ground potential when the secondary transferring device 14S is made inactive.

The configuration of the cleaning device is not limited to the configuration of the above embodiment as far as one of the first and second brush rollers electrostatically removes positively-charged toner and the other electrostatically removes negatively-charged toner.

For example, the configuration can be modified so that a power supply for the second brush roller may be provided to apply a cleaning voltage whose polarity is opposite to the polarity of toner to the second brush roller. In this configuration, a current flows through the second brush roller 26, the opposing roller 17*a*, and the first brush roller 22 in that order along the current path 33. The second brush roller 26 removes the negatively-charged toner and the first brush roller 22 removes the positively-charged toner.

Second Embodiment

The configuration of the second embodiment of the image forming apparatus is the same as that of the first embodiment of the image forming apparatus, except the cleaning device, a configuration of which will be detailed in the following.

Figure 6:
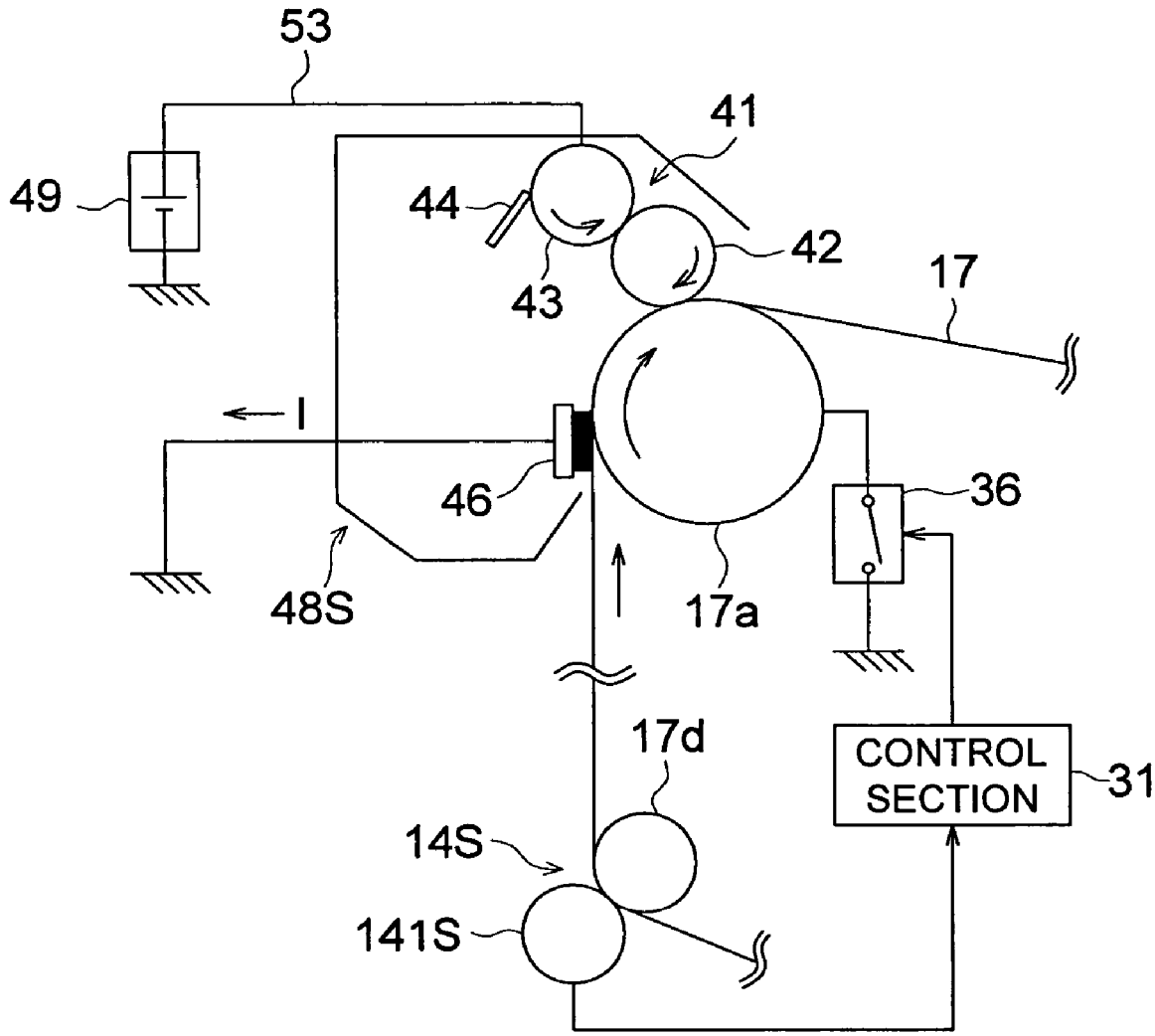
FIG. 6 shows an enlarged schematic diagram for explaining another example of a cleaning device.

As shown in FIG. 6, the cleaning device 48S is constituted by an opposing roller 17*a* disposed in such a manner that the opposing roller 17*a* contacts an inner surface of the belt-type transfer member 17, a conductive brush roller 42 (hereinafter, referred to as a brush roller 42, for simplicity) contacting outer surface of the belt-type transfer member 17 and serving as a conductive brush member, a flicker rod 43 disposed in a state of contacting the brush roller 42 and serving as a toner recovery roller, a brush roller assembly 41 including a scraper 44 disposed in a state of contacting the flicker rod 43, and a conductive fixed brush member 46 (hereinafter, referred to as a fixed brush member 46, for simplicity) contacting outer surface of the belt-type transfer member 17 at a position located upstream from the brush roller 42 in a moving direction of the belt- type transfer member 17 and serving as another conductive brush member.

The brush roller 42 is equipped in such a manner that the brush roller 42 press-contacts the opposing roller 17*a* while putting the belt-type transfer member 17 between them. Further, the configuration of the brush roller 42 is the same as that of the first brush roller 22 and the second brush roller 26 employed in the first embodiment, and a penetration amount against the belt-type transfer member 17 is set at 1 mm.

The fixed brush member 46 is equipped in such a manner that the fixed brush member 46 press-contacts the opposing roller 17*a* while putting the belt-type transfer member 17 between them. For instance, the fixed brush member 46 has bristles such as conductive nylon bristles densely implanted on the outer surface of the roller body. The brush bristles have a diameter of, for example, 5 to 8 deniers, a length of, for example, 2 to 5 mm, an electric resistance of, for example, 1.times.10.sup.4 to 1.times.10.sup.6.OMEGA., a Young's modulus of, for example, 4,900 to 9,800 N/mm.sup.2, and an implantation density (number of bristles per unit area) of, for example, 50 to 200 kilo bristles per square inch. Further, a penetration amount against the belt-type transfer member 17 is set at 1 mm.

The configuration of the flicker rod 43 is the same as those of the first flicker rod 23 and the second flicker rod 27 employed in the first embodiment. Further, a penetration amount against the brush roller 42 is set at 1 mm. Still further, the configuration of the scraper 44 is the same as those of the scrapers 24, 28 employed in the first embodiment.

The brush rollers 42 is made to rotate, for example, at a speed of 100 to 250 mm/sec in a direction opposite to the moving direction of the belt-type transfer member 17 (clockwise in FIG. 6) at a point where the brush rollers 42 contact the belt-type transfer member 17. The flicker rod 43 is made to rotate in the same direction as the brush roller 42 rotates (counterclockwise in FIG. 6).

In the cleaning device 48S, a current path 53, through which an electric current serially flows into the brush roller 42, the opposing roller 17*a* and the fixed brush member 46, is formed. In addition, there is also provided a power supply 49 for applying a cleaning voltage having a polarity opposite to the developing charge polarity of toner to the brush roller 42 through the flicker rod 43. Accordingly, when a cleaning voltage is applied to the flicker rod 43, a cleaning current flows into the brush roller 42, the opposing roller 17*a* and the fixed brush member 46 in that order through the current path 53.

By employing the current path 53, when a developing polarity of toner to be employed is, for instance, a negative polarity, since the fixed brush member 46 applies electric charge onto toner charged at a positive polarity among the residual toner remaining on the belt-type transfer member 17, the polarity of the toner originally charged at positive can be converted to negative. On the other hand, the brush roller 42 has a capability of totally removing the toner charged at the negative polarity on the belt-type transfer member 17, namely all of the residual toner on the belt-type transfer member 17.

When a developing polarity of toner to be employed is, for instance, a negative polarity, the amplitude of the cleaning voltage applied to the flicker rod 43 by the power supply 49 for applying the cleaning voltage is in a range of, for instance, +200-+1000 volts.

The image forming apparatus is equipped with a mechanism 36 to control the potential of the opposing roller 17*a*. The mechanism 36 contains a changeover switch which applies, to the opposing roller 17*a*, the same potential as that of the fixed brush member 46 when the switch is made. When the secondary transferring device 14S becomes inactive, the mechanism 36 is controlled to be active. In other words, when the secondary transferring device 14S becomes inactive, the control section 31 controls so that the potential difference between the opposing roller 17*a* and the brush roller 42 when the secondary transferring device 14S becomes inactive may be greater than the potential difference between the opposing roller 17*a* and the first brush roller 42 when the secondary transferring device 14S is active.

In the cleaning device 48S, for example, the fixed brush member 46 is earthed to the ground potential. When the control mechanism 36 becomes active, the opposing roller 17*a* is also earthed to the ground potential.

In the image forming apparatus, the cleaning operation of the residual toner on the belt-type transfer member 17 is performed by the cleaning device 48S. Concretely speaking, in a normal state, namely, when the secondary transferring device 14S is active, the power supply 49 for applying a cleaning voltage applies the cleaning voltage onto the brush roller 42 so as to flow the cleaning current into the current path 53. Then, the polarity of the toner initially charged at a positive polarity is converted to the negative by applying electric charge onto the toner by means of the fixed brush member 46. Accordingly, all of the toner charged at a negative polarity, namely, all of the residual toner remaining on the belt-type transfer member 17, are electrostatically removed.

Toner particles removed by the brush roller 42 are moved to the flicker rod 43. Toner particles on the flicker rods 43 are further scraped off by the scraper 44 into a recovery tray (not shown in the drawings) for recovery and recycling.

Meanwhile, when the secondary transferring device 14S is made inactive, the mechanism 36 to control the potential of the opposing roller is switched to earth the opposing roller 17*a* to the ground potential. Consequently, the potential difference between the opposing roller 17*a* and the brush roller 42 becomes greater. This status is very effective to remove a lot of non-transferred residual toner. In this status, the power supply 49 for applying a cleaning voltage applies a cleaning voltage to the first brush roller 42. With this, a cleaning current flows through the current path 53. Finally, the brush roller 42 electrostatically removes a lot of non-transferred residual toner which passed through the secondary transfer region, without transferring the non-transferred residual toner onto the transfer material P.

In accordance with the above image forming apparatus, when the secondary transferring device 14S is made inactive, the potential difference becomes greater between the opposing roller 17*a* and the brush roller 42 which receives a cleaning voltage whose polarity is opposite to the developing polarity of the toner. This increases the performance of the cleaning device 18S to remove toner whose polarity is opposite to the developing polarity of the toner. This can facilitate the cleaning device 48S to accomplish a preferable cleaning performance. Therefore, the cleaning device 48S can utilize its preferable cleaning performance also upon the non-transferred toner left on the belt-type transfer member. In other words, non-transferred toner can be completely removed from the belt-type transfer member 17 and images can be free from stains.

The present invention is embodied in the above description, but it should be understood that the above-described embodiment is not limited by any of the details of the foregoing description. Variations may be made by one skilled in the art without departing from the spirit and scope of the invention.

For example, as far as the potential difference between the brush roller 42 and the opposing roller 17*a* is set to a desired value when the secondary transferring device 14S is made inactive, the opposing roller 17*a* need not be earthed to the ground potential when the secondary transferring device 14S is made inactive.

The configuration of the cleaning device is not limited to the configuration of the above embodiment as far as the residual toner can be electrostatically removed from the belt-type transfer member 17, by actions of two conductive brush members.

For instance, a configuration of the cleaning device, in which a power supply for applying a cleaning voltage is provided for the brush roller so that the power supply for applying a cleaning voltage applies the cleaning voltage having a polarity opposite to that of the toner, would be also applicable. In this configuration, the cleaning current flows through the current path 53 in order of the fixed brush member 46, the opposing roller 17*a* and the brush roller 42 so that the fixed brush member 46 applies electric charge onto the toner to convert its polarity into a positive polarity. As a result, the toner charged into a positive polarity, namely, all of the residual toner are completely removed by means of the brush roller 42.

EXAMPLES

The following examples are included to confirm the effects of this invention. However, it is to be understood that the invention is not intended to be limited to the specific embodiments.

Example 1

An image forming apparatus of this invention was produced according to the configuration of FIG. 1. This image forming apparatus (variation of "8050" manufactured by Konica Minolta Business Technologies Co., Ltd.) has the following specific configuration.

(1) The developer is of a 2-component developing method.

(2) The developing agent contains toner of negative charging characteristics.

(3) The belt-type transfer member is an endless polyimide semi-conductive resin belt having a surface resistivity of $1\times10^{11}$ Ω/cm$^2$, a volume resistivity of $1\times10^{9}$ Ω·cm, and a peripheral length of 861 mm. The belt is moved at a speed of 220 mm/sec and tensioned at 49N.

(4) The cleaning device is equipped with an opposing roller 17*a* which is in contact with the inner surface of the belt-type transfer member, and first and second brush roller systems. The first brush roller system contains a first conductive brush roller which is pressed against the opposing roller with the belt therebetween, a first flicker rod which is in contact with the first brush roller, and a plate-like scraper which is in contact with the first flicker rod. The second brush roller system contains a second brush roller which is pressed against the opposing roller with the belt-type transfer member therebetween in the upstream side of the first brush roller along the movement of the belt-type transfer member, a second flicker rod which is in contact with the second brush roller, and a scraper which is in contact with the second flicker rod, and a cleaning-voltage applying device connected to the first brush roller. The second brush roller is kept at the ground potential and a current path is provided to flow a cleaning current from the cleaning voltage applying device to the first brush roller, the opposing roller, and the second brush roller in that order. The components of the cleaning device are described in detail below.

(4-1)

The opposing roller 17*a* is a hard roller made of an aluminum core bar and the outer diameter is 30 mm.

(4-2)

The first and second brush rollers respectively have bristles such as conductive nylon bristles densely implanted on the outer surface of the roller body. The brush bristles have a diameter of 6 deniers, an electric resistance of $1\times10^{10}$ Ω, a length of 5 mm, a Young's modulus of 9,800 N/mm$^2$, and an implantation density of 100 kilo bristles per square inch. The rollers are rotated at a speed of 220 mm/sec and the bite quantity of the bristles of the brush rollers to the belt-type transfer member is 1 mm.

(4-3)

The first and second flicker rods in the cleaning device are respectively made of a stainless-steel rod of 16 mm in outer diameter. The rods are rotated at a speed of 220 mm/sec and the bite quantity of the rollers to the bristles of the brush rollers is 1 mm.

(4-4)

The scraper in the cleaning device is a stainless-steel plate of 0.05 mm thick.

The image forming apparatus, which is described in the foregoing and in which a cleaning voltage of +500 V is applied to the first brush roller in the cleaning device, is employed for the actual image forming test described as follows. Further, an opposing roller potential control mechanism for switching an opposing roller potential of the opposing roller is equipped in the image forming apparatus. The opposing roller potential control mechanism is made to be active at a time when the secondary transferring device is turned into a deactivate state, so as to switch the electric potential of the opposing roller to the ground potential. The following actual image forming test is conducted in the state of activating the opposing roller potential control mechanism. The result of the actual image forming test is listed in Table 1.

Actual Image Forming Test

The surface potential of the organic photoconductive material in each toner image forming unit is made −700 V in the non-exposed area and −100 V in the exposed area. A toner image is formed on the belt-type transfer member and the formed visible image is transferred to a transfer material (by the activated secondary transferring device). A toner patch is made on the belt-type transfer member but not transferred to the transfer material (without activating the secondary transferring device). After the above operations, the belt-type transfer member is cleaned and checked for residual toner particles.

Comparative Example 1

The configuration of the image forming apparatus of this example is the same as the configuration of the image forming apparatus of Embodiment 1 but the cleaning device of this example is not equipped with the opposing roller potential control mechanism to keep the potential of the opposing roller at a working potential even when the secondary transfer device is made inactive. The actual image forming test of this example is the same as that of Embodiment 1. The result is listed in Table 1.

Comparative Example 2

The configuration of the image forming apparatus of this example is the same as the configuration of the image forming apparatus of Embodiment 1 but the cleaning device of this example is not equipped with the opposing roller potential control mechanism and the opposing roller is always earthed to the ground potential. The actual image forming test of this example is the same as that of Embodiment 1. The result is listed in Table 1.

TABLE 1

| | Opposing roller potential control mechanism | Performance to remove residual toner | Performance to remove non-transferred patch toner |
|---|---|---|---|
| Embodiment 1 | Provided | Good | Good |
| Comparative example 1 | Not provided | Good | Bad |
| Comparative example 2 | Not provided | Bad | Good |

Example 2

A cleaning device, detailed in the following, was employed as the example 2. The actual image forming test was conducted under conditions same as those for the example 1, except that the cleaning voltage of 500 volts was applied to the brush roller in the cleaning device of the example 2.

The cleaning device of the example 2 is constituted by an opposing roller disposed in such a manner that the opposing roller contacts the inner surface of the belt-type transfer member, a brush roller pressing the opposing roller while putting the belt-type transfer member between them, a flicker rod disposed in a state of contacting the brush roller, a brush roller assembly including a plate-shaped scraper disposed in a state of contacting the flicker rod, a fixed brush member pressing the opposing roller while putting the belt-type transfer member between them at a position located upstream from the brush roller in a moving direction of the belt-type transfer member, and a cleaning voltage applying power source coupled to the brush roller assembly. Further, the fixed brush member is kept at the ground potential and a current path is provided to flow a cleaning current from the cleaning voltage applying device to the brush roller, the opposing roller, and the fixed brush member in that order.

The fixed brush member of the cleaning device has bristles such as conductive nylon bristles densely implanted on the bottom surface of the fixed brush substrate. The brush bristles have a diameter of 6 deniers, an electric resistance of 1.times.10.sup.5.OMEGA., a length of 5 mm, a Young's modulus of 9,800 N/mm.sup.2, and an implantation density of 100 kilo bristles per square inch. Further, the penetration amount for the belt-type transfer member is set at 1 mm.

The structures of the opposing roller, the brush roller, the flicker rod and the scraper are the same as those of the opposing roller, the first brush roller, the first flicker rod and the scraper employed in the example 1, respectively.

Comparative Example 3

The configuration of the image forming apparatus of this example is the same as the configuration of the image forming apparatus of Example 2 but the cleaning device of this example is not equipped with the opposing roller potential control mechanism to keep the potential of the opposing roller at a working potential even when the secondary transfer device is made inactive. The actual image forming test of this example is the same as that of Example 1. The result is listed in Table 2.

Comparative Example 4

The configuration of the image forming apparatus of this example is the same as the configuration of the image forming apparatus of Example 1 but the cleaning device of this example is not equipped with the opposing roller potential control mechanism and the opposing roller is always earthed to the ground potential. The actual image forming test of this example is the same as that of Example 2. The result is listed in Table 1.

TABLE 2

| | Opposing roller potential control mechanism | Performance to remove residual toner | Performance to remove non-transferred patch toner |
|---|---|---|---|
| Embodiment 2 | Provided | Good | Good |
| Comparative example 3 | Not provided | Good | Bad |
| Comparative example 4 | Not provided | bad | Good |

As is evident from the results of the table 1 and the table 2, in the image forming apparatuses of Example 1 and Example 2 in both of which the potential of the opposing roller is earthed to the ground potential when the secondary transferring device is made inactive, the belt-type transfer member is completely cleaned without no residual toner after cleaning off toner particles left on the belt-type transfer member while the secondary transferring device is made active and after cleaning off a lot of non-transferred toner particles left on the belt-type transfer member while the secondary transferring device is made inactive.

Contrarily, in the image forming apparatuses of Comparative example 1 and Comparative example 3 in both of which the potential of the opposing roller is kept at a working potential (the potential when the secondary transferring device is active), the belt-type transfer member is clean without no residual toner after cleaning the normal residual toner particles, but has some residual toner particles after cleaning non-transferred toner particles. In other words, the image forming apparatuses of Comparative example 1 and Comparative example 3 have a cleaning problem on the belt-type transfer member.

Further, in the image forming apparatuses of Comparative example 2 and Comparative example 4 in both of which the opposing roller is always earthed to the ground potential, the belt-type transfer member is preferably cleaned without any toner particle thereon after removal of non-transferred toner particles but has some toner particles thereon after removal of residual toner particles, resulting in an occurrence of the cleaning defect of the belt-type transfer member.

In accordance with the image forming apparatus which is the first embodiment of this invention, toner particles left on the belt-type transfer member is basically cleaned off by either of two conductive brush rollers in the cleaning device independently of their charge polarities. Further, also when the secondary transferring device is made inactive, the cleaning device can clean off non-transferred toner effectively. Therefore, the image forming apparatus of this configuration can always assure complete clean-off of non-transferred toner from the belt-type transfer member and offer stain-less images.

Next will be described a cleaning device 206A which is a third embodiment (namely, Embodiment 3) of this invention. The configuration of Embodiment 3 is the same as the configuration shown in FIG. 1 but the cleaning device 206A is used instead of the cleaning device cleaning device 18S. Therefore, the explanation of the image forming apparatus excluding the cleaning device 206A is omitted here.

Figure 3:
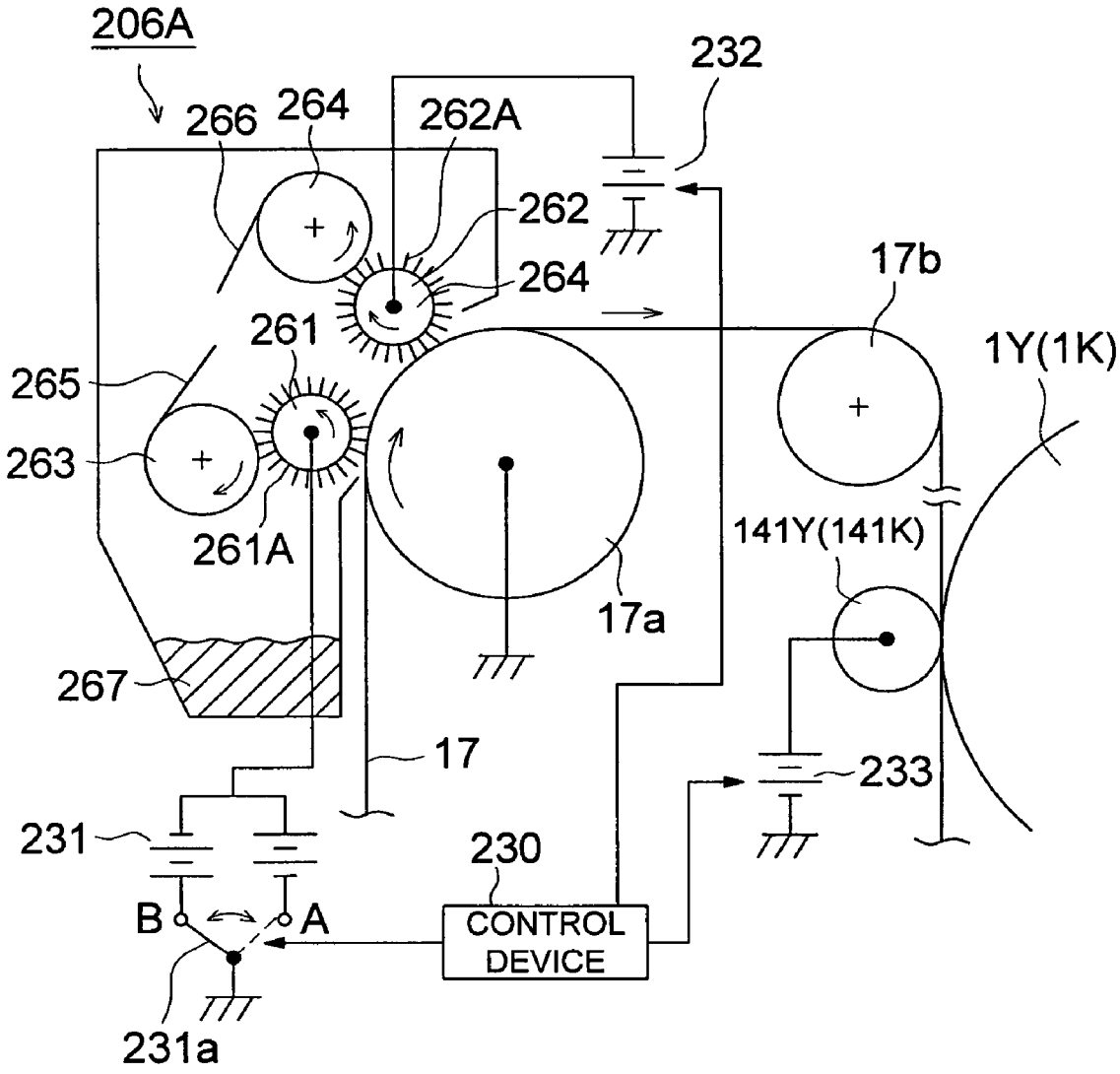
FIG. 3 shows an explanatory schematic diagram of a second cleaning device equipped in an image forming apparatus embodied in the present invention, and the electric configuration thereof.

The second cleaning device 206A will be described below referring to FIG. 3. FIG. 3 shows a schematic diagram of the second cleaning device 206A and the electric configuration thereof. The first brush roll 261 has a brush 261A (approx. 16 mm in outer diameter and resistivity of $1\times10^{10}$ to $1\times10^{11}$ Ω) of conductive acrylic fibers which is 6 deniers in diameter on the core bar. The first brush roll 261 is connected to a power supply 231 via a polarity changeover switch 231*a* to change polarities (positive or negative) of the voltage. The first brush roll 261 is in contact with the surface of the intermediate transfer member 17 by an overlap of 1 mm (a difference of the radius of the brush roll minus the distance between the center of rotation of the brush roll and the surface of the belt at which the brush roll touches the belt) and rotates at a speed of 300 revolutions per minute along the movement of the intermediate transfer member 17. An aluminum roller 17*a* whose surface is conductive and earthed to the ground is provided oppositely to the first brush roll 261 with the intermediate transfer member 17 therebetween. A stainless-steel flicker rod 253 of 16 mm in diameter is provided in contact with the brush 261A of the first brush roll 261 with an overlap (bite quantity) of 1 mm and rotates at a speed of 300 revolutions per minute in a direction opposite to the direction of the first brush roll 261 to remove toner from the brush 261A. A stainless-steel scraper 265 of 0.05 mm thick is applied to touch the surface of the flicker rod 263 against the rotation of the flicker rod 263 to scrape off toner from the surface of the flicker rod 263 into a toner recovery section 267. The second brush roll 262 has a brush 262A (approx. 16 mm in outer diameter and resistivity of $1\times10^{10}$ to $1\times10^{11}$ Ω) of conductive acrylic fibers which is 6 deniers in diameter on the core bar. The second brush roll 262 is connected to a power supply 232 to apply a voltage of positive polarity. The second brush roll 262 is located in the downstream side of the first brush roll 261 along the movement of the intermediate transfer member 17. The second brush roll 262 is in contact with the surface of the intermediate transfer member 17 by an overlap of 1 mm and rotates at a speed of 300 revolutions per minute in the direction opposite to the rotational direction of the first brush roll 261. The second brush roll 262 is also pressed against the roller 17*a* with the intermediate transfer member 17 therebetween. A stainless-steel flicker rod 264 of 16 mm in diameter is provided in contact with the brush 262A of the second brush roll 262 with an overlap (bite quantity) of 1 mm and rotates at a speed of 300 revolutions per minute in a direction opposite to the direction of the second brush roll 262 to remove toner from the brush 262A. A stainless-steel scraper 266 of 0.05 mm thick is applied to touch the surface of the flicker rod 264 against the rotation of the flicker rod 264 to scrape off toner from the surface of the flicker rod 264 into a toner recovery section 267. A power supply 233 is provided to apply a voltage to the first transfer rollers 141Y and 141K. The control device 230 containing a CPU (central processing unit, not shown in FIG. 3), work memory, and other parts works to read a program into the work memory and collectively control respective components of the image forming apparatus 100 of FIG. 1 according to the program. The control device 230 controls not only the operation of the power supplies 231, 232, and 233 but also the execution of the first mode to form images according to the normal image data and the second mode to form patch images according to patch image data.

In the first mode, the second cleaning device 206A applies a voltage of negative polarity to the first brush roller 261 and a voltage of positive polarity to the second brush roller 262. In normal printing, this first mode is used to remove residual toner from the intermediate transfer member 17. This is because some of residual toner particles are charged positively and others are charged negatively and voltages of different polarities must be applied to the first and second brush rollers 261 and 262. However, a single cleaning process in the first mode is not enough to remove a patch image from the intermediate transfer member 17 because the patch image uses a lot of toner. To remove a lot of patch image toner, the second mode uses that the polarity of toner before the secondary transferring is equal to the polarity given by the developing devices 13Y, 13M, 13C ad 13K and steady, switches the polarity of the voltage from positive to negative by the control device 30, applies the voltage of the selected polarity to the first brush roller 261, applies a voltage of positive polarity to the second brush roller 262. In other words, the first and second brush rollers 261 and 262 respectively have polarities opposite to those of the residual toner particles. With this, lots of residual toner particles are removed.

In this case, when the polarity of the first brush roller 261 is switched from negative to positive, the positively-charged toner particles are flicked towards the intermediate transfer member 17 because the first brush roller 261 and the toner particles have the same polarity. Further, since the second brush roller 262 is also charged positively, toner particles move towards the toner image forming unit 30Y through the bristles of the second brush roller 262.

When a color image is formed, a voltage of positive polarity is applied to the primary transfer roller 141Y. The primary transfer roller 141Y is pressed against the image bearing member 10Y to transfer toner back to the image bearing member 10Y. In the present embodiment, the primary transfer roller 141Y to be employed is disposed at a position nearer to the second brush roller 262 and downstream in the moving direction of the intermediate transfer member, so as to effectively conduct the cleaning operation. Then, the image bearing member 10Y is cleaned by the image bearing member cleaning device 18Y. When a black image is formed, a voltage of positive polarity is applied to the primary transfer roller 141K to transfer toner back to the image bearing member 10K. The image bearing member 10K is cleaned by the image bearing member cleaning device 18K.

The cleaning device in the second mode in accordance with Embodiment 2 can completely clean off toner particles from the intermediate transfer member regardless of whether the toner particles are normal residual toner particles or non-transferred patch image toner particles by applying a voltage of positive polarity to the first brush roller 261 and a voltage of positive polarity to the second brush roller 262, applying a voltage of positive polarity to the primary transfer roller 141Y, transferring toner particles (which are flicked from the first brush roller 261 to the intermediate transfer member 17) back to the image bearing member 10Y, and cleaning off positively-charged toner particles which are back-transferred by the cleaning device 18Y.

Figure 4:
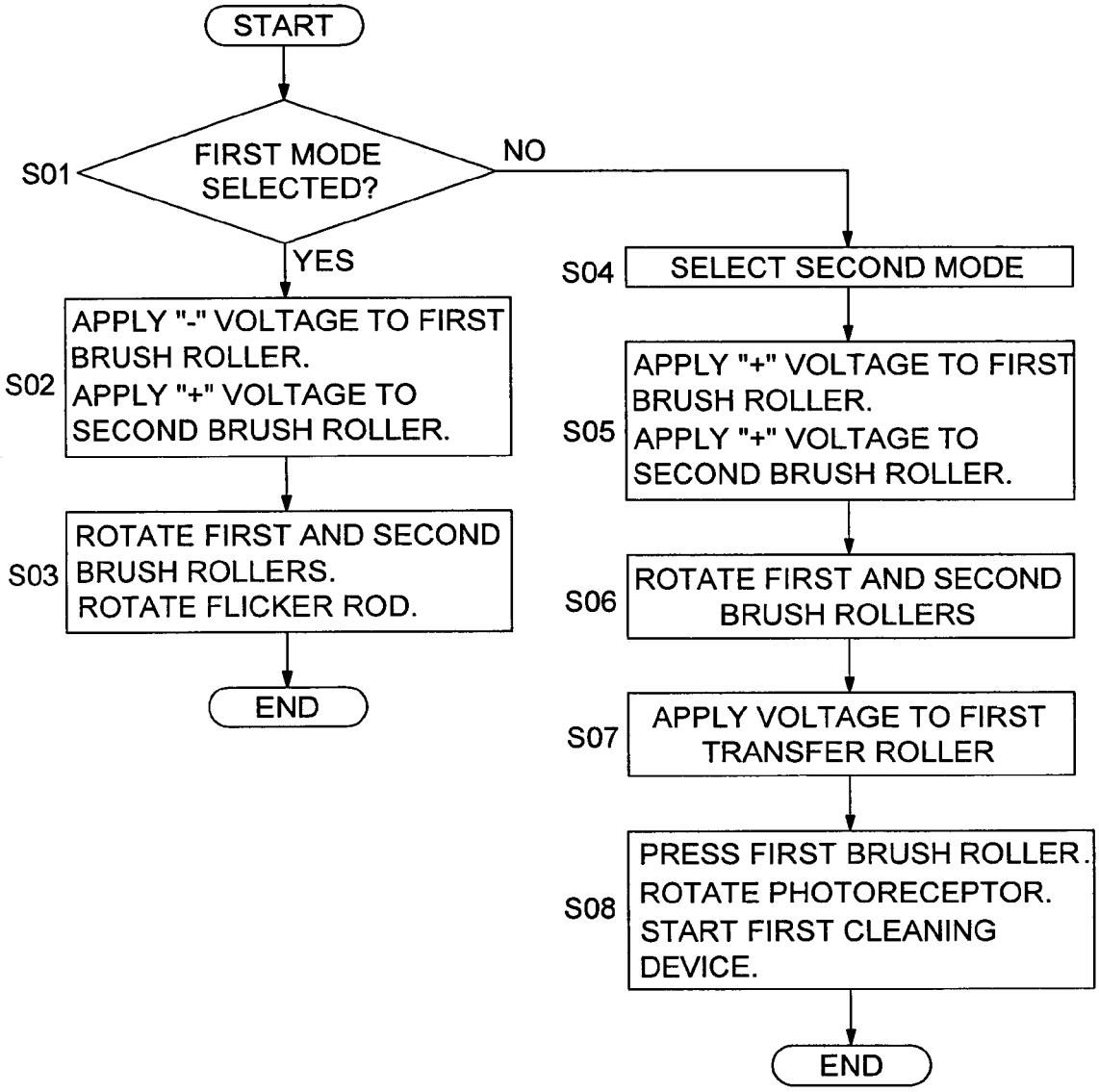
FIG. 4 shows a flow chart of a process executed by a color image forming apparatus to clean an intermediate transfer member.
Figure 5:
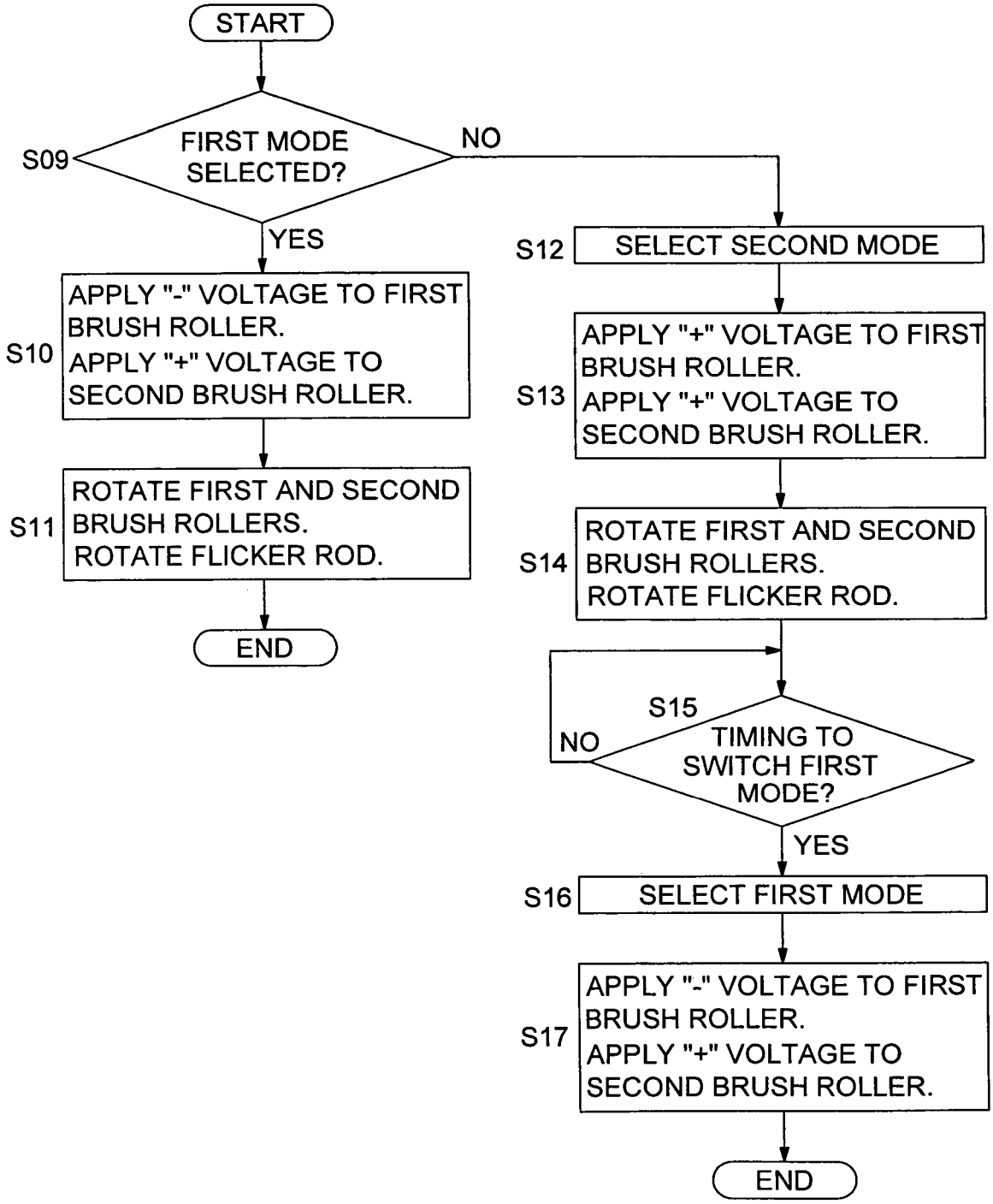
FIG. 5 shows a flow chart of another cleaning process executed by a color image forming apparatus to clean an intermediate transfer member.

Referring to FIG. 4 and FIG. 5, will be described a cleaning method of the image forming apparatus of this embodiment. FIG. 4 shows a flow chart of a process executed by a color image forming apparatus to clean the intermediate transfer member 17. The flow chart of FIG. 4 assumes that the color image forming apparatus is powered on and the control device 230 is set to automatically start the first or second mode. When the first mode is selected (YES at step S01), steps S02 and S03 follow. Step S02 applies a voltage of negative polarity selected by the control device 230 from the power supply 231 to the first brush roller 261 and a voltage of positive polarity from the power supply 232 to the second brush roller 262. Step S03 rotates the first and second brush rollers 261 and 262 by a motor (not shown in drawings) and the flicker rods 263 and 264 by a motor (not shown in drawings) simultaneously. When the first mode is not selected (NO at step S01), steps S04 and later follow. Step S04 selects the second mode. Step S05 applies a voltage of positive polarity selected by the control device 230 from the power supply 231 to the first brush roller 261 and a voltage of positive polarity from the power supply 232 to the second brush roller 262. Step S06 rotates the first and second brush rollers 261 and 262 by a motor (not shown in drawings) and the flicker rods 263 and 264 by a motor (not shown in drawings) simultaneously. Step S07 applies a voltage of a selected polarity to the primary transfer roller 141Y from the power supply 233 to make toner particles flicked by the first brush roller 261 and toner particles passing through bristles of the first brush roller 262. Step S08 rotates the image bearing member 10Y, presses the primary transfer roller 141Y against the image bearing member 10Y to transfer toner particles from the intermediate transfer member 17 back to the image bearing member 10Y, and actuates the cleaning device 18Y to clean the image bearing member 10Y. At Step S07, in this case, when a black image is formed, it is possible to apply a voltage of a selected polarity to the primary transfer roller 141Y, transfer toner particles back to the image bearing member 10K which is always rotating in contact therewith, and clean the image bearing member 10K by the cleaning device 18K.

The cleaning device in the second mode in accordance with this embodiment may completely clean off toner particles from the intermediate transfer member regardless of whether the toner particles are normal residual toner particles or non-transferred patch image toner particles by applying a voltage of positive polarity to the first brush roller 261 and a voltage of positive polarity to the second brush roller 262, applying a voltage of positive polarity to the primary transfer roller 141Y, transferring toner particles (which are flicked from the first brush roller 261 to the intermediate transfer member 17) back to the image bearing member 10Y, and cleaning the image bearing member 10Y by the image bearing member cleaning device 18Y. FIG. 5 shows a flow chart of another cleaning process in accordance with this invention. Similar as in FIG. 4, the flow chart of FIG. 5 assumes that the color image forming apparatus is powered on and the control device is set to automatically start the first or second mode.

Step S09 checks whether the first mode is selected. When the first mode is selected (YES at step S09), steps S10 and S11 follow. Step S10 applies a voltage of negative polarity selected by the control device 230 from the power supply 231 to the first brush roller 261 and a voltage of positive polarity from the power supply 232 to the second brush roller 262. Step S11 rotates the first and second brush rollers 261 and 262 by a motor (not shown in drawings) and the flicker rods 263 and 264 by a motor (not shown in drawings) simultaneously.

When the first mode is not selected (NO at step S12), steps S13 and later follow. Step S12 selects the second mode. Step S13 applies a voltage of positive polarity selected by the control device 230 from the power supply 231 to the first brush roller 261 and a voltage of positive polarity from the power supply 232 to the second brush roller 262. Step S14 rotates the first and second brush rollers 261 and 262 by a motor (not shown in drawings) and the flicker rods 263 and 264 by a motor (not shown in drawings) simultaneously. Step S15 conveys toner particles flicked by the first brush roller 261 and toner particles passing through bristles of the first brush roller 262 from the intermediate transfer member 17. Before the toner particles reach the first and second brush rollers 261 and 262, the control device 230 checks a timing whether switching to the first mode is required. When switching to the first mode is required (YES at Step S15), Step S17 applies a voltage of negative polarity to the first brush roller 261 from the power supply 231 and a voltage of positive polarity to the second brush roller 262 from the power supply 232.

Next, toner particles on the intermediate transfer member 17 are cleaned off by the cleaning device 206A. When determined that the timing is not a timing for switching to the first mode (NO at Step S15), control is returned to Step S15 and the control device checks the timing whether mode switching is required again.

According to the present embodiment mentioned in the above, at first, the cleaning operation in the second mode is conducted, and then, the cleaning operation in the first mode is conducted successively. Accordingly, even for the patch image or the residual toner image at the time of jamming, in which a relatively large amount of toner is remained as the residual toner, it becomes possible to surly conduct the cleaning operation.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

a toner image forming unit to form a toner image on an image bearing member by employing toner;

an intermediate transfer member driven to rotate;

a primary transferring unit to transfer said toner image formed on said image bearing member onto said intermediate transfer member;

a first cleaning unit to remove residual toner remaining on said image bearing member after a primary transferring operation is completed;

a secondary transferring unit to transfer said toner image residing on said intermediate transfer member onto a transfer material;

a second cleaning unit to clean residual toner remaining on said intermediate transfer member, wherein said second cleaning unit includes a first brush roller and a second brush roller disposed at a position downstream from said first brush roller in a moving direction of said intermediate transfer member, each of which is driven to rotate while contacting said intermediate transfer member so as to clean said intermediate transfer member; and a controller to control a voltage to be applied to said first brush roller and a voltage to be applied to said second brush roller, and to control said primary transferring unit;

wherein said image forming apparatus is provided with a first mode in which image forming operations based on normal image data are conducted and a second mode in which patch image forming operations based on patch image data are conducted; and wherein, in said first mode, said controller applies a voltage having a negative polarity to said first brush roller, a voltage having a positive polarity to said second brush roller and a voltage having a predetermined polarity to said primary transferring unit, respectively, while in said second mode, said controller applies a voltage having a positive polarity to said first brush roller, a voltage having a positive polarity to said second brush roller and a voltage having a positive polarity to said primary transferring unit, respectively.

2. The image forming apparatus of claim 1, wherein said first brush roller and said second brush roller are electrically conductive.

3. The image forming apparatus of claim 1, further comprising:

a conductive opposing roller disposed opposite said first brush roller while putting said intermediate transfer member between them.

4. A cleaning method for cleaning residual toner in an image forming apparatus, the method comprising:

forming a toner image on an image bearing member by employing toner;

transferring said toner image formed on said image bearing member onto an intermediate transfer member;

removing residual toner remaining on said image bearing member after a primary transferring operation is completed;

transferring said toner image residing on said intermediate transfer member onto a transfer material; and cleaning residual toner remaining on said intermediate transfer member, wherein said second cleaning unit includes a first brush roller and a second brush roller disposed at a position downstream from said first brush roller in a moving direction of said intermediate transfer member, each of which is driven to rotate while contacting said intermediate transfer member so as to clean said intermediate transfer member;

applying a voltage having a negative polarity to said first brush roller and a voltage having a positive polarity to said second brush roller, respectively, in a first mode in which image forming operations based on normal image data are conducted;

applying a voltage having a positive polarity to said first brush roller and a voltage having a positive polarity to said second brush roller, respectively, in a second mode in which patch image forming operations based on patch image data are conducted;

applying a voltage having a positive polarity to said primary transferring unit in order to inversely transfer toner, ejected from said first brush roller to said intermediate transfer member, onto said image bearing member; and removing said toner inversely transferred onto said image bearing member by means of said first cleaning unit.

5. The cleaning method of claim 4, wherein said image forming apparatus includes both a color image bearing member and a black image bearing member, each serving as said image bearing member; and wherein, when forming a color image, said toner ejected from said first brush roller to said intermediate transfer member are inversely transferred onto said color image bearing member, while, when forming a monochrome image, said toner ejected from said first brush roller to said intermediate transfer member are inversely transferred onto said black image bearing member.

6. The cleaning method of claim 4, wherein said first brush roller and said second brush roller are electrically conductive.

7. The cleaning method of claim 4, wherein said image forming apparatus further includes:

a conductive opposing roller disposed opposite said first brush roller while putting said intermediate transfer member between them.

* * * * *